US012686982B2

(12) United States Patent
Li

(10) Patent No.: US 12,686,982 B2
(45) Date of Patent: Jul. 21, 2026

(54) AUGER ASSEMBLY AND SNOW THROWER

(71) Applicant: Greenworks (Jiangsu) Co., Ltd., Changzhou (CN)

(72) Inventor: Shuhua Li, Changzhou (CN)

(73) Assignee: Greenworks (Jiangsu) Co., Ltd., Changzhou (CN)

( * ) Notice: Subject to any disclaimer, the term of this patent is extended or adjusted under 35 U.S.C. 154(b) by 351 days.

(21) Appl. No.: 18/447,285

(22) Filed: Aug. 9, 2023

(65) Prior Publication Data

US 2024/0068191 A1 Feb. 29, 2024

(30) Foreign Application Priority Data

Aug. 29, 2022 (CN) ..... 202211042802.X
Aug. 29, 2022 (CN) ..... 202222284783.3

(51) Int. Cl.
*E01H 5/09* (2006.01)

(52) U.S. Cl.
CPC ..... *E01H 5/098* (2013.01)

(58) Field of Classification Search
CPC ..... E01H 5/098
See application file for complete search history.

(56) References Cited

U.S. PATENT DOCUMENTS

2016/0138235 A1* 5/2016 Friberg ..... E01H 5/098 37/260
2018/0334781 A1* 11/2018 Yuan ..... E01H 5/045
2019/0194892 A1 6/2019 Koltz et al.
2019/0264405 A1 8/2019 Duchscherer et al.

FOREIGN PATENT DOCUMENTS

CA 2301358 C 5/2007
CN 2659953 Y * 12/2004
CN 110644414 A * 1/2020 ..... E01H 5/098
JP H0235107 A * 2/1990

* cited by examiner

*Primary Examiner* — Matthew R Buck

(57) ABSTRACT

The disclosure relates to an auger assembly and a snow thrower including a supporting shaft; a snow throwing paddle, a left and right snow scraper assembly. The snow throwing paddle in a middle of the supporting shaft rotates synchronously with the supporting shaft. The left and right snow scraper assemblies are symmetrical to each other with respect to a particular plane that is perpendicular to an axis of the supporting shaft. The left snow scraper assembly includes a snow scraper helically spiraled around the supporting shaft along an axial direction of the supporting shaft. The snow scraper is spliced by at least two-section split helical blades each helical blade provided with a connecting part at an end away from the snow throwing paddle. The connecting part is connected with the supporting shaft. One of the helical blades closest to the snow throwing paddle is connected with the snow throwing paddle.

14 Claims, 7 Drawing Sheets

AUGER ASSEMBLY AND SNOW THROWER

CROSS REFERENCE TO RELATED APPLICATION

The present application claims the priority of the following Chinese patent applications: serial No. CN202211042802.X, filed Aug. 29, 2022, and serial No. CN 202222284783.3, filed Aug. 29, 2022; the disclosure of which is hereby incorporated by reference herein in its entirety for all purposes.

TECHNICAL FIELD

The disclosure relates to a field of snow thrower, and in particular, relates to an auger assembly of a snow thrower.

BACKGROUND

A snow thrower operates by gathering the snow on the surface of a road using its snow scraper, and then throw the gathered snow away from the road using its snow throwing paddle. The conventional snow throwers may have the following defects: 1. their augers may have a lot of parts and components that need to be tiresomely assembled, resulting the thrown snow not being gathered around or concentrated; 2. their augers are easy to bend and deform when throwing snow under high force, resulting in poor snow throwing effect; 3. the snow collecting and snow throwing parts of these auger are made of rubber, which may cause the rubber to deform easily when the snow is thrown under high force, resulting in low snow-throwing efficiency; 4. the area ratios between the snow throwing part and the snow collecting part of the auger are not suitable, which may result in a large snow throwing load, and may cause the snow not be thrown far away.

SUMMARY

The present disclosure provides an auger assembly and a snow thrower with reliable structural strength.

Specifically, the disclosure provides an auger assembly that includes: a supporting shaft; a snow throwing paddle, a left snow scraper assembly and a right snow scraper assembly. The snow throwing paddle is mounted in a middle of the supporting shaft and assembled to rotate synchronously with the supporting shaft. The left snow scraper assembly respectively and the right snow scraper assembly are located on two sides of the snow throwing paddle and are symmetrical to each other with respect to a particular plane that is perpendicular to an axis of the supporting shaft. The left snow scraper assembly includes a snow scraper, and the snow scraper is helically spiraled around the supporting shaft along an axial direction of the supporting shaft. The snow scraper is spliced by at least two-section split helical blades, and each section of the helical blade includes a connecting part located at an end that is away from the snow throwing paddle. The connecting part is connected with the supporting shaft. One of the helical blades closest to the snow throwing paddle is connected with the snow throwing paddle.

In an embodiment of the disclosure, the left snow scraper assembly includes at least two snow scrapers, and each of the snow scrapers is evenly arranged with a specific interval along a circumferential direction of the supporting shaft, and each helical blade of each snow scraper located in a same section in the axial direction of the supporting shaft shares the same connecting part.

In an embodiment of the disclosure, the helical blade and the connecting part are of an integral structure.

In an embodiment of the disclosure, a depressed part is formed on the connecting part which is closest to an end of the supporting shaft, the depressed part is located around the supporting shaft, and the depressed part is caved toward a direction away from the end of the supporting shaft.

In an embodiment of the disclosure, in a projection along the axial direction of the supporting shaft for all the helical blades connecting with the same connecting part, for a specific helical blade, its arc center angle is an angle corresponding to an outermost arc profile related to this specific helical blade. And a sum of an arc center angles for all helical blades corresponding to an outermost arc profile of each helical blade is greater than or equal to 100° and less than or equal to 360°.

In an embodiment of the disclosure, a shape of an area, which is connected with the helical blade that is on the connecting part closest to the end of the supporting shaft, is a planar structure and is perpendicular to the axis of the supporting shaft. And the shape of the area, which is connected with the helical blade on the other connecting parts, are twisted into a shape consistent with the helical blade.

In an embodiment of the disclosure, the snow throwing paddle includes at least two paddles, and the paddles are cantilevered along a radial direction of the supporting shaft, a central area on a front side of the paddle in a rotation direction is depressed toward a rear side in the rotation direction, and left and right ends of the paddle in the front side in the rotation direction are warped toward the front side in the rotation direction.

In an embodiment of the disclosure, a through hole is arranged on the paddle near the supporting shaft.

In an embodiment of the disclosure, the paddle is provided with a rubber plate, the rubber plate is detachably connected with the paddle, and protrudes from an edge of the paddle along the radial direction of the supporting shaft.

In an embodiment of the disclosure, the paddles are formed as an integrated structure, and a shaft hole is arranged between the paddles to enable the supporting shaft to pass through, a radial hole is arranged on a side wall of the shaft hole and the supporting shaft, and a positioning bolt is arranged in the radial hole.

In an embodiment of the disclosure, a flanged edge is arranged on an edge of the paddle along the radial direction of the supporting shaft away from the supporting shaft, and the flanged edge protrudes backward in the rotation direction of the paddle.

In an embodiment of the disclosure, in the axial direction of the supporting shaft, a ratio between a length of the snow throwing paddle and a length of the left snow scraper assembly is greater than or equal to 0.1 and less than or equal to 2.5.

In an embodiment of the disclosure, a ratio between a maximum diameter of a projection of the auger assembly in the axial direction of the supporting shaft and a length of the supporting shaft is greater than or equal to 0.1 and less than or equal to 1.

In an embodiment of the disclosure, an outer edge of the snow scraper is provided with a sawtooth cut or a bending flange.

The disclosure further provides the snow thrower. The snow thrower includes a main body and an auger assembly.

The main body is provided with a driving device. The auger assembly mounted on a front end of the main body and includes a supporting shaft; a snow throwing paddle, a left snow scraper assembly and a right snow scraper assembly. The supporting shaft is connected with the driving device using a transmission mechanism. The snow throwing paddle is mounted in a middle of the supporting shaft and assembled to rotate synchronously with the supporting shaft. The left snow scraper assembly and the right snow scraper assembly are located on two sides of the snow throwing paddle respectively and are symmetrical to each other with respect to a particular plane that is perpendicular to an axis of the supporting shaft. The left snow scraper assembly includes a snow scraper, and the snow scraper is helically spiraled around the supporting shaft along an axial direction of the supporting shaft. The snow scraper is spliced by at least two-section split helical blades, and each section of the helical blade includes a connecting part located at an end that is away from the snow throwing paddle. The connecting part is connected with the supporting shaft. One of the helical blades closest to the snow throwing paddle is connected with the snow throwing paddle.

Technical effect of the disclosure is:

The snow scraper of the present disclosure is configured as a multi-section structure, a connecting part is arranged at ends of each section of the helical blade, and an inner-most helical blade is fixedly connected with the snow throwing paddle, so that both ends of each section of the helical blade are effectively fixed, which avoids a problem of bending deformation caused by long spans, and improves a structural strength of the auger assembly.

In the disclosure, the two helical blades that are located at the same axial position may form an integrated structure with the same connecting part 32, the two helical blades and one connecting part form a single component, creating a modular design of the snow scraper that simplifies the assembly structure, improves assembly efficiency, and facilitates easy maintenance of the snow scraper.

A structure of the snow throwing paddle of the disclosure can enable a throwing path to be more concentrated and improve snow throwing efficiency; when there is too much snow accumulated in a middle of the supporting shaft, part of the snow on the front side in the rotation direction of the paddle may overflow to the rear side in the rotation direction of the paddle through the through hole, so as to avoid overloading of the snow throwing paddle.

DETAILED DESCRIPTION

The following describes the implementation of the disclosure through specific embodiments, and those skilled in the art can easily understand other advantages and effects of the disclosure from the content disclosed in this specification. The disclosure may also be implemented or applied through other different specific embodiments. Various details in this specification may also be modified or changed based on different viewpoints and applications without departing from the disclosure. It should be noted that, in a case of no conflict, following embodiments and features in the embodiments may be combined with each other.

It should be noted that drawings provided in the embodiments are for illustrative of a basic idea of the disclosure. The drawings may show assemblies related to the disclosure instead of drawing according to the number, shape and size of the assemblies in actual implementation. In actual implementation, the type, quantity and ratio of each assembly may be changed at will, and a layout of the assemblies may also be more complicated.

Please refer to FIG. 1 through FIG. 14. A technical solution of the present disclosure may be described in detail below, which may be operative in combination with a walk-behind snow thrower. It should be understood that the disclosure may be implemented an improvement on an auger part of the snow thrower, so no special requirement is needed on the type of walking mode the snow thrower is under. In other words, the auger assembly of the present disclosure may be applicable to any walk-behind snow throwers, and may also be applied to any ride-on snow throwers, hand-held snow throwers and the like.

Figure 14:
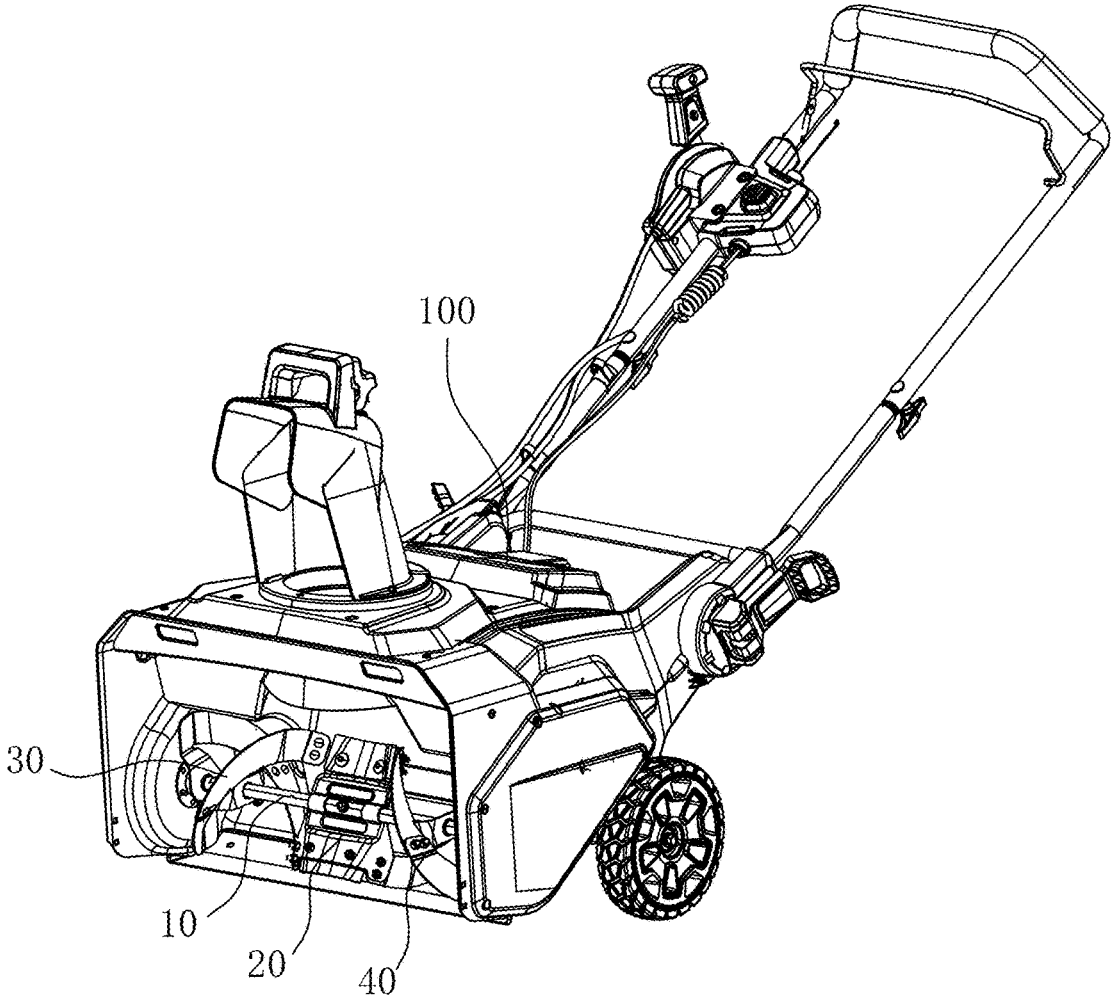
FIG. 14 is a perspective view of a snow thrower according to an embodiment of the disclosure.

Please refer to FIG. 14, in which a walk-behind snow thrower may include a main body 100 and an auger assembly. The main body 100 may be implemented with a driving device. It should be understood that the driving device is configured to drive the rotating of the auger assembly. The walk-behind snow thrower may also include a walking device and a control device. In the walk-behind snow thrower of this embodiment, the control device may be arranged on, e.g., a handle of the snow thrower. The walking device and the auger assembly may share a common power source, or each of which may be equipped with its own independent power sources. The power source may be, for example, an internal combustion engine or an electrical motor. When using the electrical motor, the snow thrower may also be equipped with a comparable power module, such as a battery pack.

Please refer to FIG. 1 through FIG. 13. The auger assembly is mounted on a front end of the main body 100, and the auger assembly includes a supporting shaft 10, a snow throwing paddle 20, a left snow scraper assembly 30, and a right snow scraper assembly 40. In a specific embodiment, the front end of the main body 100 may contain an auger housing for accommodating the auger assembly. A front end of the auger housing may have an opening for gathering snow, and the rear part and the top part of the auger assembly may be surrounded by the auger housing to prevent the snow from splashing. An upper end of the auger housing may have a snow throwing path/tunnel for guiding the direction of the snow throwing.

Please refer to FIG. 1 through FIG. 13. The supporting shaft 10 may be connected with the driving device using a transmission mechanism. It should be understood that, any connection mechanism for the transmission may be feasible, including e.g., gear transmission, pulley transmission and the like.

Please refer to FIG. 1 through FIG. 4, FIG. 11 and FIG. 12. The snow throwing paddle 20 is mounted in a center of the supporting shaft 10 and is assembled to be able to rotate synchronously with the supporting shaft 10. The left snow scraper assembly 30 and the right snow scraper assembly 40 are located on two sides of the snow throwing paddle, and are symmetrical to each other with respect to a particular plane that is perpendicular to an axis of the supporting shaft 10. In a specific embodiment, in order to keep two ends of the auger assembly in balance, the particular plane may be, for example, a plane at a center of the supporting shaft 10. During a rotation of the supporting shaft 10, the left snow scraper assembly 30 and the right snow scraper assembly 40 gather the snow towards the middle of the supporting shaft 10, and the snow throwing paddle 20 is configured to throw the gathered snow upward and out.

Figure 1:
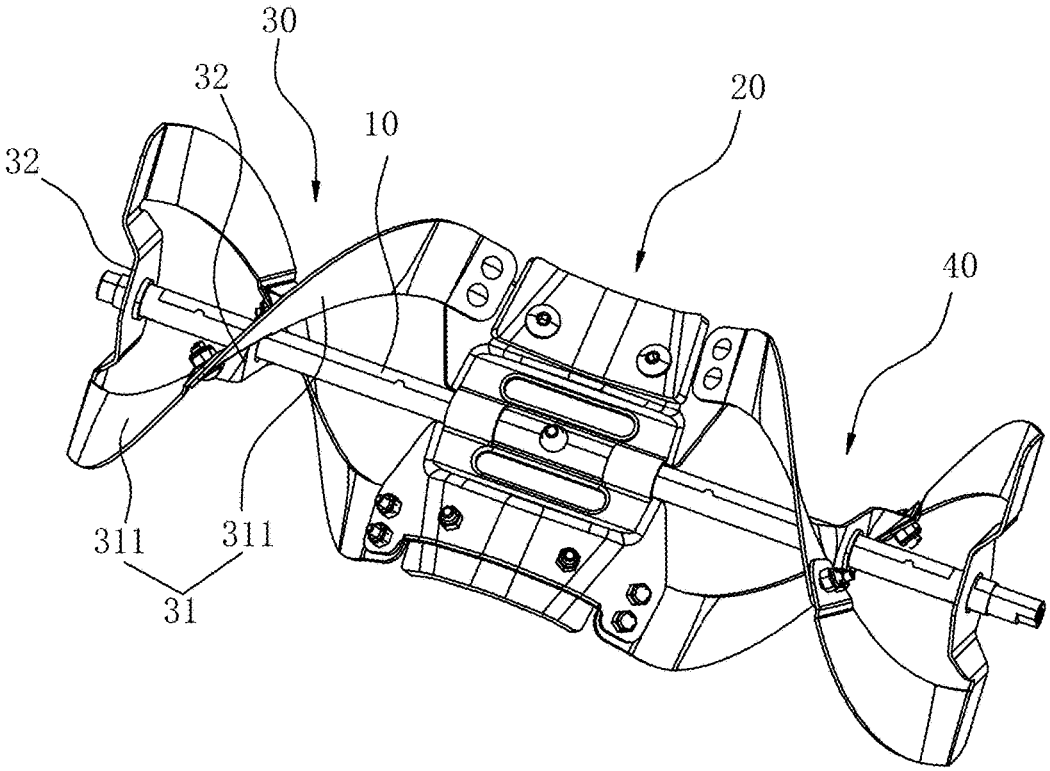
FIG. 1 is a perspective view of an auger assembly according to an embodiment of the disclosure.

Please refer to FIG. 1. In this embodiment, structures of the right snow scraper assembly 40 and the left snow scraper assembly 30 are substantially symmetrical, so the following content mainly describes the structure of the left snow scraper in detail.

Please refer to FIG. 1 through FIG. 10. The left snow scraper assembly 30 includes a snow scraper 31, and the snow scraper 31 is helically spiraled around the supporting shaft 10 along an axial direction of the supporting shaft 10. The snow scraper 31 is spliced/jointed by at least two-section split helical blades 311, and each section of the helical blade 311 includes a connecting part 32 located at an end that is away from the snow throwing paddle 20. The connecting part 32 may be connected with the supporting shaft 10. One of the helical blades 311 closest to the snow throwing paddle 20 is connected with the snow throwing paddle 20. Specifically, the part where the helical blade 311 is connected with the snow blowing paddle 20 is the end away from the connecting part 32. Comparing with a single-structure auger, the disclosure provides the snow scraper 31 with a multi-section structure, and provides the connecting part 32 at an end of each section of the blade. An inner-most blade is fixedly connected with the snow throwing paddle 20, so that both ends of each blade are effectively fixed, which avoids bending and deformation caused by long spans, and improves a structural strength of the auger assembly.

Figure 2:
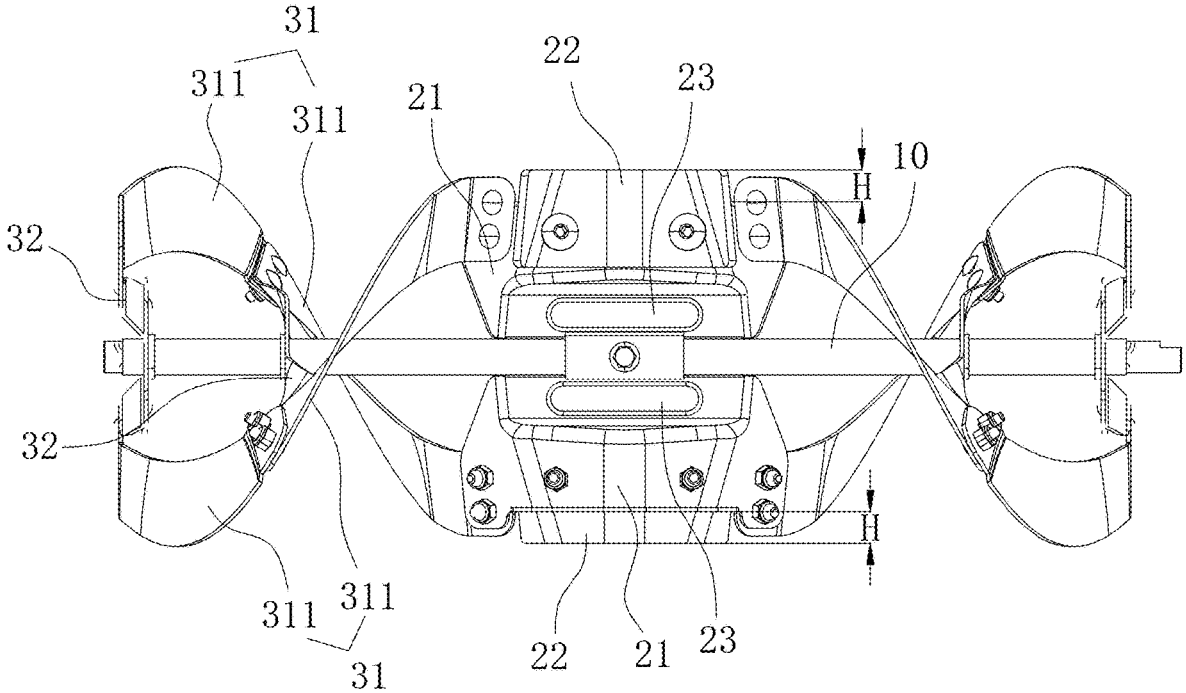
FIG. 2 is a front view of the auger assembly according to an embodiment of the disclosure.

Please refer to FIG. 1 and FIG. 2. There may be at least two snow scrapers 31, and each of the snow scrapers 31 is evenly arranged with a specific interval along a circumferential direction of the supporting shaft 10, and each helical blade 311 of each snow scraper 31 located in the same section in the axial direction of the supporting shaft 10 shares the same connecting part 32. In this embodiment, each snow scraper 31 is formed by sequentially connecting two helical blades 311, which means that the left snow scraper assembly 30 of this embodiment includes a total of four helical blades 311. The snow scrapers 31 of the disclosure are not limited to two, and may have for example, three or more.

Figure 4:
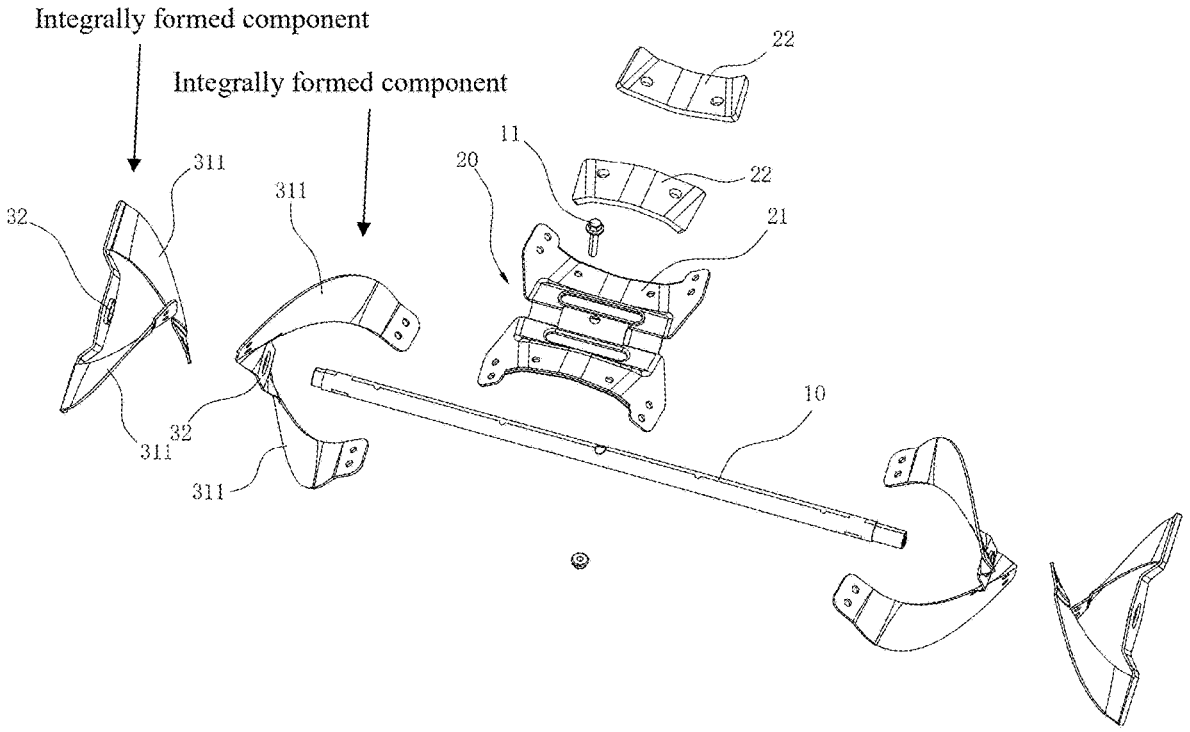
FIG. 4 is an exploded view of the auger assembly according to an embodiment of the disclosure.

Please refer to FIG. 4. In a specific embodiment, the helical blade 311 and the connecting part 32 are integrally structured. In this embodiment, the two helical blades 311 that are located at the same axial position may form an integrated structure with the same connecting part 32. In other words, the two helical blades 311 and one connecting part 32 may form a single component, creating a modular design of the snow scraper 31 that simplifies the assembly structure, improves assembly efficiency, and facilitates easy maintenance of the snow scraper 31.

Figure 5:
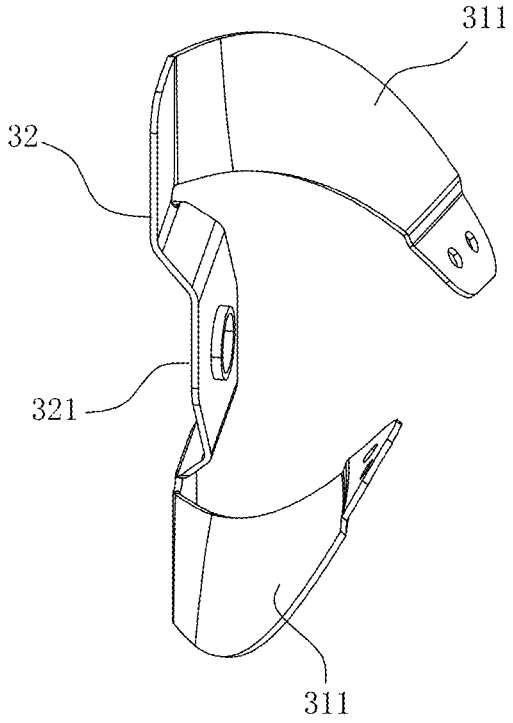
FIG. 5 is a perspective view of an outer helical blade and a connecting part according to an embodiment of the disclosure.
Figure 6:
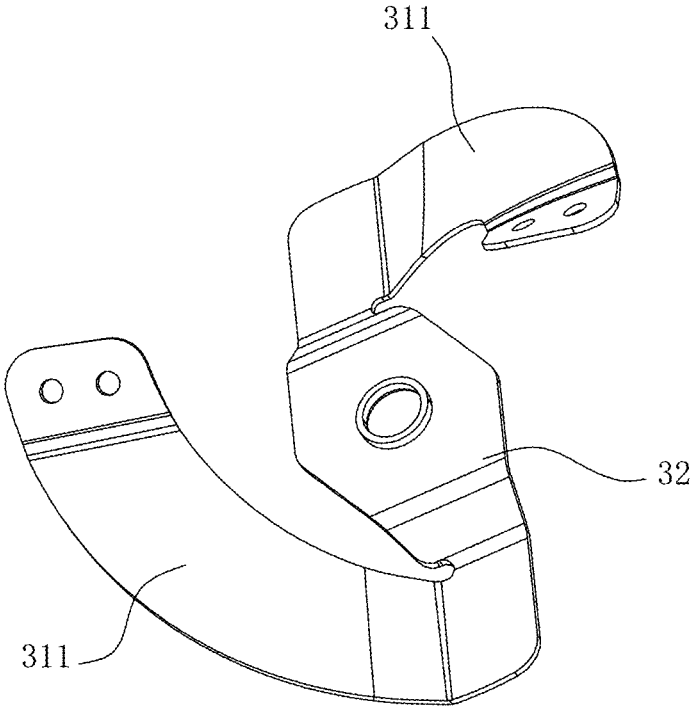
FIG. 6 is a perspective view from another angle of the outer helical blade and the connecting part according to an embodiment of the disclosure.
Figure 7:
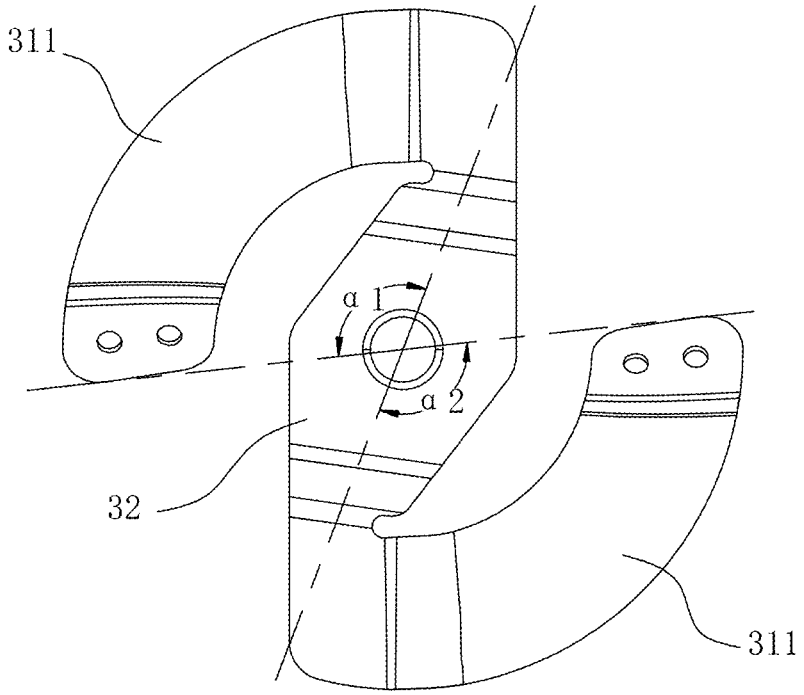
FIG. 7 is a side view of the outer helical blade and the connecting part according to an embodiment of the disclosure.
Figure 8:
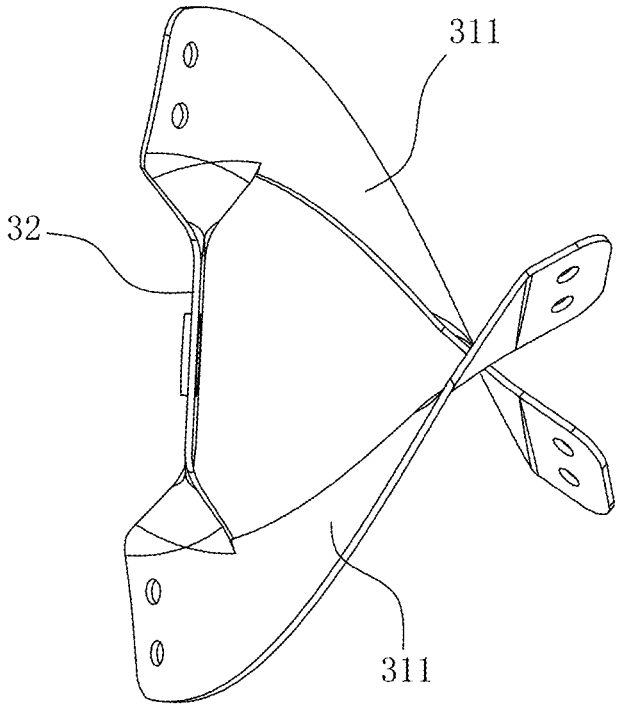
FIG. 8 is a perspective view of an inner helical blade and the connecting part according to an embodiment of the disclosure.
Figure 9:
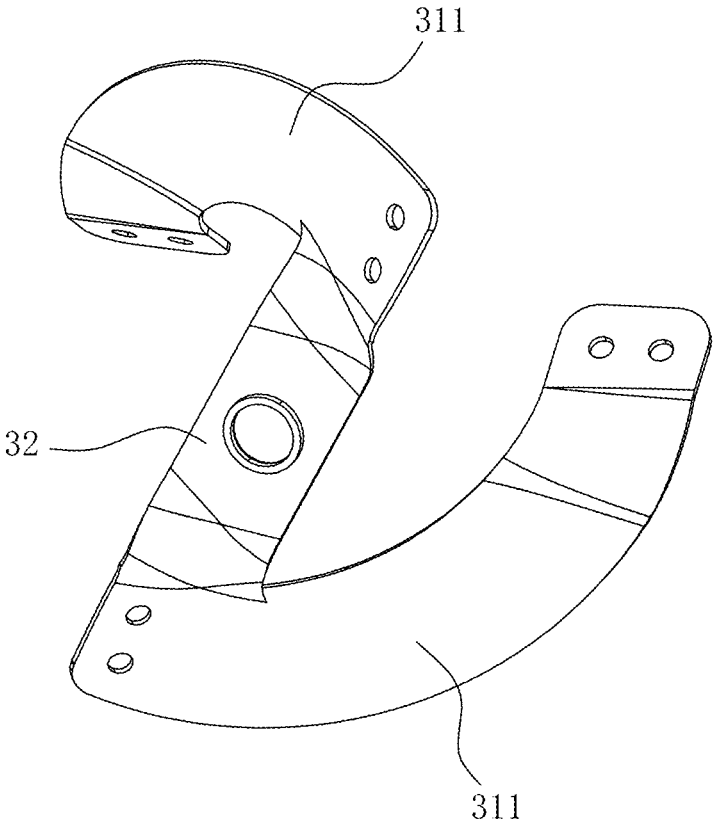
FIG. 9 is a perspective view from another angle of the inner helical blade and the connecting part according to an embodiment of the disclosure.

Please refer to FIG. 5 through FIG. 7. A depressed part 321 is formed on the connecting part 32 closest to an end of the supporting shaft 10, the depressed part 321 is located around the supporting shaft 10, and the depressed part 321 is caved toward a direction that is away from the end of the supporting shaft 10. It should be understood that the depressed part 321 can avoid an interference with the connection structure at the end of the supporting shaft 10, so that the snow scraper 31 may be as close as possible to both ends of the auger housing, thereby avoiding dead spots in snow cleaning.

Figure 10:
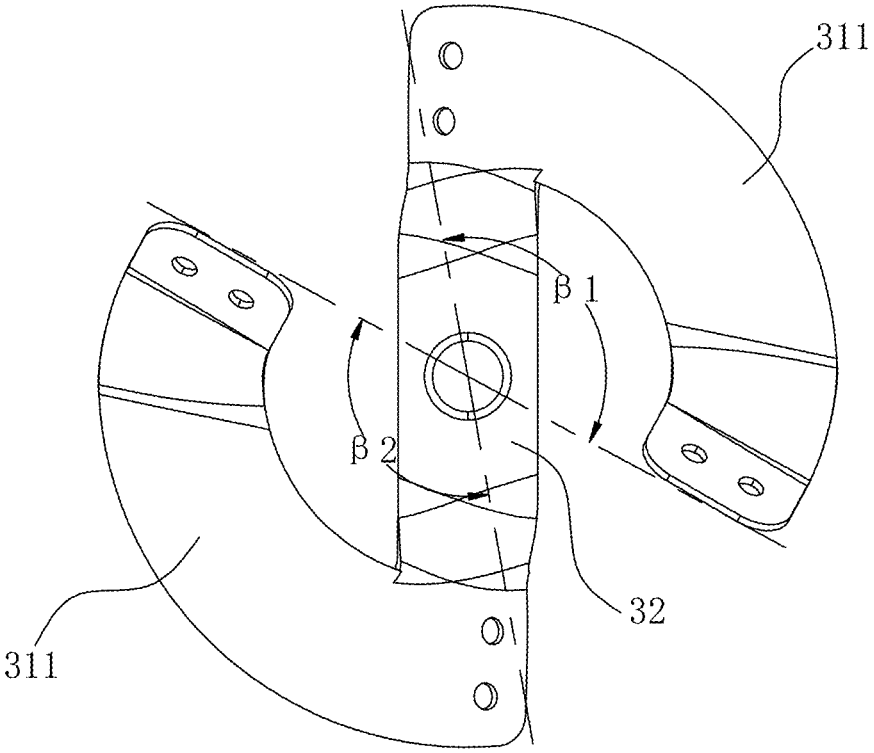
FIG. 10 is a side view of the inner helical blade and the connecting part according to an embodiment of the disclosure.

Please refer to FIG. 7 and FIG. 10. In a projection along the axial direction of the supporting shaft 10 for all the helical blades 311 connecting with the same connecting part 32, for a specific helical blade 311, its arc center angle may be an angle corresponding to an outermost arc profile related to this specific helical blade 311. And the sum of the arc center angles for all helical blades 311 may be greater than or equal to 100° and less than or equal to 360°. As illustrated in FIG. 7, $\alpha 1$ and $\alpha 2$ may be the corresponding two arc center angles for the two helical blades 311, and $100° \leq \alpha 1 + \alpha 2 \leq 360°$. Similarly, as illustrated in FIG. 10, $\beta 1$ and $\beta 2$ may be the two arc center angles for the two helical blades 311, and $100° \leq \beta 1 + \beta 2 \leq 360°$. A sum of an arc center angles of the above two sections can be greater than 360°, thereby realizing a continuous cutting and transmission of snow. In this embodiment, a sheet thickness t of the snow scraper 31 may be from 0.8 mm to 5 mm.

Please refer to FIG. 5 through FIG. 10. The shape of an area, which is connected with the helical blade 311 that is on the connecting part 32 closest to the end of the supporting shaft 10, may have a planar/flat structure and is perpendicular to the axis of the supporting shaft 10. And the shape of the area, which is connected with the helical blade 311 on the remaining connecting parts 32, are twisted into a shape consistent with the helical blade 311, such an approach ensures that a surface of an auger is smooth to prevent snow from accumulating on the auger. In this embodiment, the area connected to the helical blade 311 on the connecting part 32 closest to the end of the supporting shaft 10 is set as a plane so as to ensure that the connecting part 32 is adapted to an inner wall of the auger housing, and a gap between the connecting part 32 and the inner wall is reduced. In other embodiments, this area may have any shape that is not flat.

Please refer to FIG. 1 through FIG. 4, FIG. 11 and FIG. 12. The snow throwing paddle 20 includes at least two paddles 21, and the paddles 21 are cantilevered along a radial direction of the supporting shaft 10. A central area on a front side of the paddle 21 in a rotation direction is depressed/caved toward a rear side in the rotation direction, and left and right ends of the paddle 21 in the front side in the rotation direction are warped toward the front side in the rotation direction. In other words, the rotation direction in the disclosure refers to a rotation direction of the auger assembly during operation of the snow thrower, and a structure of the snow throwing paddle 20 in the above form can enable throwing paths to be more concentrated, thereby improve snow throwing efficiency.

Figure 11:
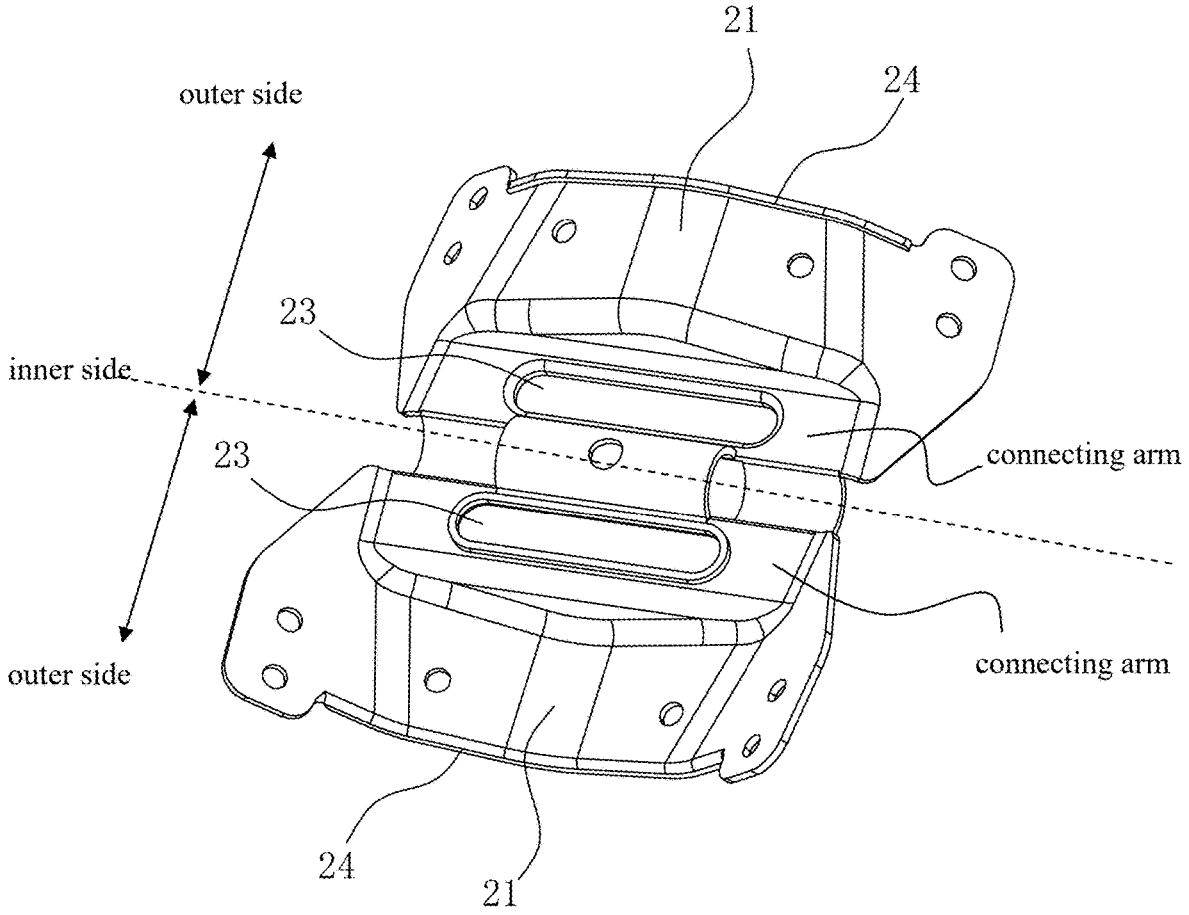
FIG. 11 is a perspective view of a snow throwing paddle according to an embodiment of the disclosure.
Figure 12:
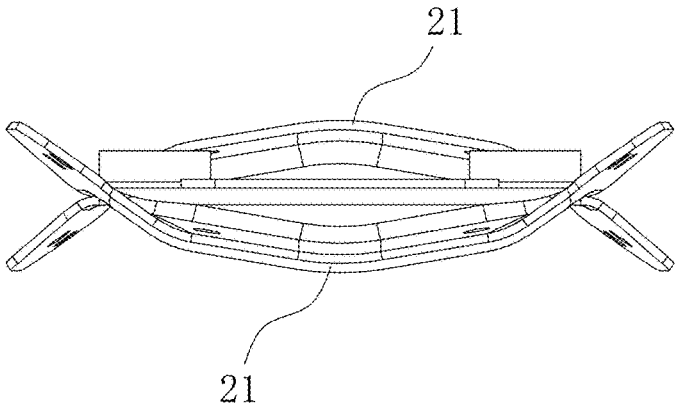
FIG. 12 is an end view of the snow throwing paddle according to an embodiment of the disclosure.
Figure 13:
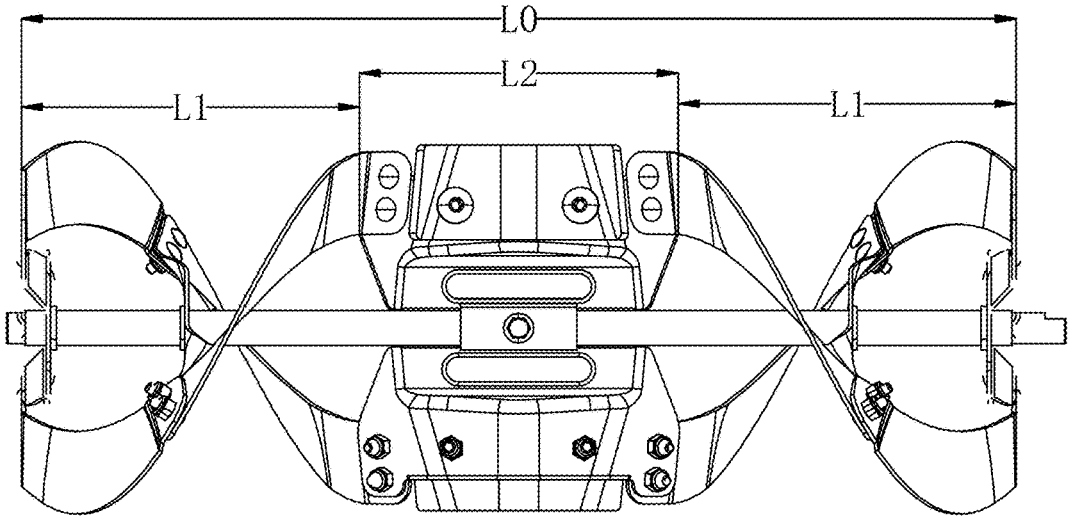
FIG. 13 is a second front view of the auger assembly according to an embodiment of the disclosure.

Please refer to FIG. 11. A through hole 23 is arranged on the paddle 21 near the supporting shaft 10. When there is too much snow accumulated in the middle of the supporting shaft 10, part of the snow accumulated on the front side of the paddle 21 in the rotation direction may overflow/run-off to the rear side of the paddle 21 in the rotation direction through the through hole 23, thereby preventing the paddle 21 from being overloaded.

Please refer to FIG. 2. The paddle 21 is provided with a rubber plate 22. The rubber plate 22 is detachably connected with the paddle 21, and protrudes from an edge of the paddle 21 along the radial direction of the supporting shaft 10. In this embodiment, a length H of the rubber plate 22 protruding from the edge of the paddle 21 satisfies the following conditions: H is more than or equal to 3 mm and less than or equal to 30 mm. In some embodiments, H may be around 15 mm. A sufficient allowance may be preserved between the rubber plate 22 and the paddle 21 to ensure a duration life of the paddle 21.

Please refer to FIG. 11. The two paddles 21 may be formed as an integrated structure, and a shaft hole is arranged between the paddles 21 to enable the supporting shaft 10 to pass through. A radial hole is arranged on a side wall of the shaft hole and the supporting shaft 10, and a positioning bolt 11 is arranged in the radial hole. In this embodiment, the snow throwing paddle may be formed by e.g., pressing different parts together into one piece. The snow throwing paddle has a simple structure and is easy to assemble.

Please refer to FIG. 11. A flanged edge 24 is arranged on an edge of the paddle 21 along the radial direction of the supporting shaft 10 away from the supporting shaft 10, and the flanged edge 24 protrudes backward in the rotation direction of the paddle 21. The flanged edge 24 can strengthen a force-bearing area of the paddle 21 and may prevent the paddle 21 from being deformed.

Figure 3:
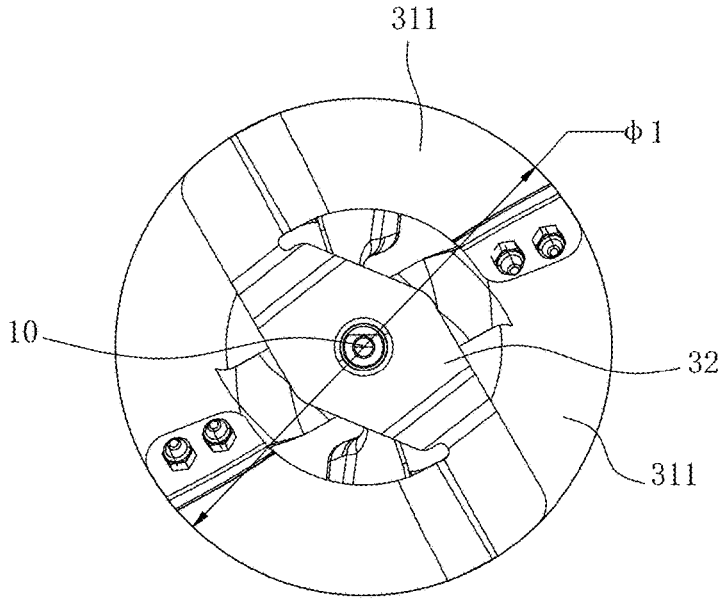
FIG. 3 is a side view of the auger assembly according to an embodiment of the disclosure.

Please refer to FIG. 3 and FIG. 11. In a specific embodiment, in the axial direction of the supporting shaft, a ratio between a length L2 of the snow throwing paddle 20 and a length L1 of the left snow scraper assembly 31 may be greater than or equal to 0.1 and less than or equal to 2.5, which is reflected in FIG. 13 as being $0.1 \leq L2/L1 \leq 2.5$. A ratio between a maximum diameter $\phi 1$ of a projection of the auger assembly along the axial direction of the supporting shaft 10 and a length L0 of the supporting shaft 10, may be greater than or equal to 0.1 and less than or equal to 1, which is reflected in FIG. 3 and FIG. 13 as being $0.1 \leq \phi 1/L0 \leq 1$. The proportional relationships among the different parts provided in this disclosure can ensure working efficiency of the snow scraper 31, allow the snow throwing paddle 20 to be adapted to each other, enable an amount of collected snow and an amount of thrown snow to be in a roughly balanced state, and prevent the snow throwing paddle 20 from being overloaded or under-loaded. For example, an outer edge of the snow scraper 31 may be provided with a sawtooth cut or a bending flange, or a concave-convex structure may be arranged on the snow scraper 31 to further improve the structural strength of the snow scraper 31.

In summary, on a basis of a typical snow scraper, the snow scraper 31 of the present disclosure is further configured as a multi-section structure. A connecting part 32 is arranged at the end of each section of the helical blade, and an innermost helical blade is fixedly connected with the snow throwing paddle 20, so that both ends of each section of the helical blade are effectively fixed, which reduces/minimizes the problem of bending deformation caused by long spans, and improves the structural strength of the auger assembly.

In the disclosure, the two helical blades 311 at the same axial position and the same connecting part 32 form an integrated structure, the two helical blades 311 and one connecting part 32 may form a single component, creating a modular design of the snow scraper 31 that simplifies the assembly structure, improves assembly efficiency, and facilitates easy maintenance of the snow scraper 31.

A structure of the snow throwing paddle 20 of the disclosure can enable a throwing path to be more concentrated and improve snow throwing efficiency. When there is too much snow accumulated in the middle of the supporting shaft 10, part of the snow on the front side in the rotation direction of the paddle 21 may overflow/run-off to the rear side in the rotation direction of the paddle 21 through the through hole 23, so as to avoid overloading of the snow throwing paddle 20.

The above-mentioned embodiments merely illustrate the principles and effects of the disclosure, but are not intended to limit the disclosure. Anyone skilled in the art may modify or change the above embodiments without departing from the range of the disclosure. Therefore, all equivalent modifications or changes made by those with ordinary knowledge in the technical field without departing from the range and technic disclosed in the disclosure should still be covered by the claims of the disclosure.

What is claimed is:

1. An auger assembly, comprising:

a supporting shaft;

a snow throwing paddle, mounted in a middle of the supporting shaft and assembled to rotate synchronously with the supporting shaft; and a left snow scraper assembly and a right snow scraper assembly, located on two sides of the snow throwing paddle respectively and symmetrical to each other with respect to a particular plane that is perpendicular to an axis of the supporting shaft, wherein the left snow scraper assembly comprises at least two snow scrapers, and each of the at least two snow scrapers is helically spiraled around the supporting shaft along an axial direction of the supporting shaft, and the each of the at least two snow scrapers is spliced by at least N-section split helical blades, each section of the helical blade comprises a connecting part located at an end that is away from the snow throwing paddle, the connecting part is connected with the supporting shaft, and one of the helical blades closest to the snow throwing paddle is connected with the snow throwing paddle;

each helical blade of the at least two snow scrapers located in a same section in the axial direction of the supporting shaft shares a same connecting part, and two helical blades located in the same section in the axial direction of the supporting shaft form an integrated structure with the same connecting part, the two helical blades and the same connecting part form a single piece of integrally formed component, the left snow scraper assembly includes at least N pieces of the integrally formed components, and the N pieces of the integrally formed components are detachably connected, wherein N is an integer greater than or equal to 2.

2. The auger assembly according to claim 1, wherein a depressed part is formed on the connecting part which is closest to an end of the supporting shaft, the depressed part is located around the supporting shaft, and the depressed part is caved toward a direction away from the end of the supporting shaft.

3. The auger assembly according to claim 1, wherein in a projection along the axial direction of the supporting shaft for all the helical blades connecting with the same connecting part, for a specific helical blade, its arc center angle is an angle corresponding to an outermost arc profile related to this specific helical blade, a sum of the arc center angles for all helical blades is greater than or equal to 100° and less than or equal to 360°.

4. The auger assembly according to claim 1, wherein a shape of an area, which is connected with the helical blade that is on the connecting part closest to the end of the supporting shaft, is a planar structure and is perpendicular to the axis of the supporting shaft, and the shape of the area, which is connected with the helical blade on the other connecting parts, are twisted into a shape consistent with the helical blade.

5. The auger assembly according to claim 1, wherein the snow throwing paddle comprises at least two paddles, the at least two paddles are cantilevered along a radial direction of the supporting shaft, a central area on a front side of each of the at least two paddles in a rotation direction is depressed toward a rear side in the rotation direction, the central area is also at an outer side of the each of at least two paddles away from the supporting shaft along a radial direction of the supporting shaft, and left and right ends on the front side of the each of the at least two paddles in the rotation direction are warped toward the front side in the rotation direction;

a concave direction of the central area is opposite to a warping direction of the left and right ends, and a warping curvature at each of the left and right ends is greater than a concave curvature of the central area, causing an overall surface of the each of at least two paddles shaped as a concave bottom and an upward-sloping sidewalls at the left and right ends of the concave bottom;

the left and right ends of the each of the at least two paddles away from the supporting shaft along the radial direction of the supporting shaft are provided with screw holes for mounting the corresponding helical blades; and the overall surfaces of the at least two paddles are centrally symmetrical about a center of the supporting shaft.

6. The auger assembly according to claim 5, wherein an inner side of the each of the at least two paddles close to the supporting shaft along the radial direction of the supporting shaft are provided with a connecting arm, the connecting arm connects the left and right ends on the inner side of the each of the at least two paddles, the connecting arm is a flat plane substantially parallel to a horizontal direction, a single elongated through hole is arranged on the connecting arm along a length direction of the supporting shaft, a ratio between a length of the elongated through-hole along the length direction and a length of the supporting shaft is greater than or equal to 2; and there is a gap between the overall surface of each paddle and the connecting arm of the each paddle, in order to discharge overloaded snow from the elongated through-hole and from the gap.

7. The auger assembly according to claim 5, wherein the paddle is provided with a rubber plate, and the rubber plate is detachably connected with the paddle and protrudes from an edge of the paddle along the radial direction of the supporting shaft.

8. The auger assembly according to claim 5, wherein the paddles are formed as an integrated structure, a shaft hole is arranged between the paddles to enable the supporting shaft to pass through, and a radial hole is arranged on a side wall of the shaft hole and the supporting shaft, and a positioning bolt is arranged in the radial hole.

9. The auger assembly according to claim 5, wherein a flanged edge is arranged on an edge of the paddle along the radial direction of the supporting shaft away from the supporting shaft, and the flanged edge protrudes backward in the rotation direction of the paddle.

10. The auger assembly according to claim 1, wherein in the axial direction of the supporting shaft, a ratio between a length of the snow throwing paddle and a length of the left snow scraper assembly is greater than or equal to 0.1 and less than or equal to 2.5.

11. The auger assembly according to claim 1, wherein a ratio between a maximum diameter of a projection of the auger assembly along the axial direction of the supporting shaft and a length of the supporting shaft is greater than or equal to 0.1 and less than or equal to 1.

12. The auger assembly according to claim 1, wherein an outer edge of the snow scraper is provided with a sawtooth cut or a bending flange.

13. The auger assembly according to claim 1, wherein adjacent integrally formed components at a joint of the adjacent integrally formed components are provided with holes correspondingly to detachably connect the adjacent integrally formed components together through bolts passing through the holes and the adjacent integrally formed components at the joint share a same connecting part to connect with the supporting shaft.

14. A snow thrower, comprising:

a main body, provided with a driving device; and an auger assembly, mounted on a front end of the main body, comprising:

a supporting shaft, connected with the driving device using a transmission mechanism, a snow throwing paddle, mounted in a middle of the supporting shaft and assembled to rotate synchronously with the supporting shaft, and a left snow scraper assembly and a right snow scraper assembly, located on two sides of the snow throwing paddle respectively and symmetrical to each other with respect to a particular plane that is perpendicular to an axis of the supporting shaft at a center of the supporting shaft, wherein the left snow scraper assembly comprises at least two snow scrapers, and each of the at least two snow scrapers is helically spiraled around the supporting shaft along an axial direction of the supporting shaft, and each of the at least two snow scrapers is spliced by at least N-section split helical blades, each section of the helical blade comprises a connecting part located at an end that is away from the snow throwing paddle, the connecting part is connected with the supporting shaft, and one end of the helical blades closest to the snow throwing paddle that is away from the connecting part is connected with the snow throwing paddle;

each helical blade of the at least two snow scrapers located in a same section in the axial direction of the supporting shaft shares a same connecting part, and two helical blades located in the same section in the axial direction of the supporting shaft form an integrated structure with the same connecting part, the two helical blades and the same connecting part form a single piece of integrally formed component, the left snow scraper assembly includes at least N pieces of the integrally formed components, and the N pieces of the integrally formed components are detachably connected, wherein N is an integer greater than or equal to 2.

* * * * *